US010974316B2

(12) United States Patent
Kuwauchi et al.

(10) Patent No.: US 10,974,316 B2
(45) Date of Patent: Apr. 13, 2021

(54) SECONDARY COOLING METHOD AND SECONDARY COOLING DEVICE FOR CASTING PRODUCT IN CONTINUOUS CASTING

(71) Applicant: NIPPON STEEL & SUMITOMO METAL CORPORATION, Tokyo (JP)

(72) Inventors: Yuki Kuwauchi, Tokyo (JP); Hitoshi Funagane, Tokyo (JP); Satoru Hayashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 198 days.

(21) Appl. No.: 16/061,444

(22) PCT Filed: Jan. 27, 2017

(86) PCT No.: PCT/JP2017/003053
§ 371 (c)(1),
(2) Date: Jun. 12, 2018

(87) PCT Pub. No.: WO2017/131204
PCT Pub. Date: Aug. 3, 2017

(65) Prior Publication Data

US 2018/0354024 A1 Dec. 13, 2018

(30) Foreign Application Priority Data

Jan. 29, 2016 (JP) ..... JP2016-016252

(51) Int. Cl.
*B22D 11/124* (2006.01)
*B22D 11/22* (2006.01)

(52) U.S. Cl.
CPC ..... *B22D 11/1246* (2013.01); *B22D 11/124* (2013.01); *B22D 11/1245* (2013.01); *B22D 11/225* (2013.01)

(58) Field of Classification Search
CPC ..... B22D 11/124; B22D 11/1245; B22D 11/1246; B22D 11/22; B22D 11/225
(Continued)

(56) References Cited

FOREIGN PATENT DOCUMENTS

CN 10360047 A 2/2014
CN 103842113 A 6/2014
(Continued)

OTHER PUBLICATIONS

International Search Report for PCT/JP2017/003053 dated Apr. 18, 2017.

(Continued)

*Primary Examiner* — Kevin P Kerns
(74) *Attorney, Agent, or Firm* — Birch, Stewart, Kolasch & Birch, LLP

(57) ABSTRACT

A secondary cooling method and a secondary cooling device for a casting product casted in a continuous casting machine, the continuous casting machine including, in a secondary cooling zone below a mold, a plurality of pairs of support rolls that support the casting product from both sides of the casting product in a thickness direction, a cooling device being disposed between support rolls adjacent to each other along a casting direction of the continuous casting machine, the cooling device including a coolant pipe that supplies a coolant, and a coolant guide plate with a flat plate shape for spreading the coolant on the casting product, the coolant guide plate being disposed parallel to and spaced in a perpendicular direction from a surface of the casting product.

9 Claims, 5 Drawing Sheets

(58) Field of Classification Search
USPC ..... 164/486, 487, 444
See application file for complete search history.

(56) References Cited

FOREIGN PATENT DOCUMENTS

| | | | |
|---|---|---|---|
| JP | 53-5505 | U1 | 1/1978 |
| JP | 5-84455 | U | 11/1993 |
| JP | 9-201661 | A | 8/1997 |
| JP | 10-137833 | A | 5/1998 |
| JP | 2002-86253 | A | 3/2002 |
| JP | 2003-62647 | A | 3/2003 |
| JP | 2007-111772 | A | 5/2007 |
| JP | 4055440 | B2 | 3/2008 |
| JP | 2009-202166 | A | 9/2009 |
| JP | 4453562 | B2 | 4/2010 |
| JP | 2010-110813 | A | 5/2010 |
| JP | 2011-183435 | A | 9/2011 |
| JP | 5146006 | B2 | 2/2013 |
| JP | 2014-200803 | A | 10/2014 |
| JP | 5598614 | B2 | 10/2014 |

OTHER PUBLICATIONS

Nakagawa et al., "Modeling and Stability Analysis of Cooling Control in the Transition Boiling Region", Transactions of the Society of Instrument and Control Engineers, 2012, vol. 48, No. 4, pp. 207-213, total 8 pages.
Written Opinion of the International Searching Authority for PCT/JP2017/003053 (PCT/ISA/237) dated Apr. 18, 2017.
International Preliminary Report on Patentability and English translation of the Written Opinion of the International Searching Authority(FormsPCT/IB/373 and PCT/ISA/237), dated Jul. 31, 2018, for International Application No. PCT/JP2017/003053.
Canadian Office Action, dated Jun. 12, 2019, for corresponding Canadian Application No. 3,006,369.
Chinese Office Action and Search Report, dated Sep. 4, 2019, for Chinese Application No. 201780005339.2, with a partial English translation.
Korean Office Action, dated Aug. 26, 2019, for Korean Application No. 10-2018-7018133, with a partial English translation.
Communication pursuant to Rules 70(2) and 70a(2) EPC, dated May 14, 2019, forwarding Extended European Search Report, dated Apr. 26, 2019, for corresponding European Application No. 17744434.6.
European Communication pursuant to Article 94(3) EPC for corresponding European Application No. 17744434.6, dated Jan. 23, 2020.

SECONDARY COOLING METHOD AND SECONDARY COOLING DEVICE FOR CASTING PRODUCT IN CONTINUOUS CASTING

TECHNICAL FIELD

The present invention relates to a secondary cooling method and a secondary cooling device in performing continuous casting of a casting product in a continuous casting machine.

BACKGROUND ART

In continuous casting in the iron and steel industry, conventionally, spray-type cooling has been widely performed as a method for secondary cooling of a casting product. In this secondary cooling method, spray nozzles are arranged between support rolls that convey a casting product, and cooling water is put into a spray form and sprayed on the surface of the casting product for cooling.

Spray-type cooling has a problem of overcooling due to so-called dripping water and standing water. Dripping water is, in a sectional roll serving as a support roll for a casting product, cooling water that falls to the downstream side from a bearing, which does not come into contact with the casting product. Standing water is cooling water that stays in a space surrounded by a roll circumferential surface and a casting product surface. When cooling water jetted from the spray nozzles interferes with dripping water or standing water, the interference portion is subjected to overcooling, which makes cooling ununiform in a width direction of the casting product.

Hence, for example, Patent Literature 1 discloses a secondary cooling method that improves cooling uniformity by suppressing overcooling due to dripping water and standing water, by appropriately adjusting an arrangement of spray nozzles and an amount of cooling water in accordance with occurrence spots of the dripping water and standing water.

Moreover, in the case of a spray type, water is splattered by jetting water to a hot casting product, and jetted water is not efficiently used, which limits cooling performance. Therefore, in order to raise casting speed to improve productivity in the future, it is necessary to significantly increase an amount of supplied water or increase a secondary cooling zone by extending a machine length of a continuous casting machine. In other words, current continuous casting machines are not adaptable, and a significant improvement in heat transfer coefficient in secondary cooling is desired for faster continuous casting.

Conventionally, in order to reduce temperature unevenness in secondary cooling for uniform cooling, for example, Patent Literature 2 discloses a secondary cooling method that performs cooling with surface temperature of a casting product held in a film boiling region, and describes disposing a perforated plate between rolls and ejecting cooling water.

In addition, as a method for improving cooling performance of secondary cooling, for example, Patent Literature 3 discloses a cooling grid facility using a wear plate.

In addition, for example, Patent Literature 4 discloses a secondary cooling method for a continuous casting product that enhances cooling performance by cooling a casting product by using water film flow.

In addition, for example, Patent Literature 5 discloses a secondary cooling method for a continuous casting product that enhances cooling performance by forming a continuous bed with water film flow between a guide plate and a casting product and cooling the casting product.

CITATION LIST

Patent Literature

Patent Literature 1: JP 5598614B
Patent Literature 2: JP 5146006B
Patent Literature 3: JP 4453562B
Patent Literature 4: JP 2002-086253A
Patent Literature 5: JP H9-201661A

SUMMARY OF INVENTION

Technical Problem

However, the present inventors have found by extensive studies that the above secondary cooling methods have problems as described below.

In the case of Patent Literature 1, although the influence of dripping water and standing water can be suppressed to some extent, the influence of the dripping water and standing water cannot be completely prevented as long as a large amount of cooling water is used in the spray type. Therefore, there is still room for improvement in cooling uniformity. In addition, spray-type cooling is limited in cooling performance as described above.

In the case of Patent Literature 2, since cooling water is jetted from a plurality of ejection holes aligned in a longitudinal direction of the casting product, interference between jets of cooling water and stay of cooling water accompanying this are likely to occur, which disables uniform cooling.

Moreover, in the case of Patent Literature 2, since the plurality of ejection holes are thus formed in the longitudinal direction of the casting product, cooling water jetted from one ejection hole travels a short distance. Furthermore, since the casting product is cooled while being conveyed, the casting product is cooled by cooling water from one ejection hole and then cooled also by cooling water from other ejection holes. Then, in a certain portion of the casting product in the longitudinal direction, local cooling is performed repeatedly; thus, cooling by cooling water from all the ejection holes is not constant in some cases. In such a case, a stable cooling region and an unstable cooling region are mixed on a cooling surface of the casting product, which results in unstable cooling on the cooling surface of the casting product.

Furthermore, the method disclosed in Patent Literature 2 cools the casting product using only a coolant in the film boiling region to prevent overcooling. However, in the film boiling region, a heat transfer coefficient is lower than in a transition boiling region, and a significant improvement in cooling performance cannot be expected. In addition, cooling water is not caused to evaporate after cooling in the film boiling region.

In the case of Patent Literature 3, a cooling function is imparted to the wear plate included in the cooling grid facility. However, since the wear plate is in contact with the casting product, flaws occur on the surface of the casting product, causing a problem in quality; hence, practical application is difficult.

In the case of Patent Literature 4, which discloses a secondary cooling method for continuous casting that forms water film flow of a thickness of 0.1 to 2.5 mm by supplying water from a water supply port provided in each water-film forming plate to a gap between a casting product and the water-film forming plates that continuously move in a direction opposite to a drawing direction of the casting product and are driven using an endless track (Crawler) or the like, for example, since cooling water is supplied from a plurality of water supply ports aligned in a longitudinal direction, interference between jets of cooling water and stay of cooling water accompanying this are likely to occur, which disables uniform cooling.

Moreover, in the case of water film flow of a thickness of 0.1 to 2.5 mm, the casting product is cooled in mainly from a non-boiling region to a nucleate boiling region, as will be described later, and not cooled in the transition boiling region. Furthermore, a gap of a thickness of 0.1 to 2.5 mm is small, which leads to low flexibility in installing the water-film forming plates.

In the case of Patent Literature 5, a water film flow continuous bed of a thickness of 0.1 to 2.5 mm is formed as in the case of Patent Literature 4 by supplying water from a water supply port provided in the guide plate to a space between the guide plate and the casting product. Also in such a case, the casting product is cooled in mainly from the non-boiling region to the nucleate boiling region, and not cooled in the transition boiling region. In addition, a gap between the guide plate and the casting product is small, which leads to low flexibility in installing the guide plate.

Hence, an object of the present invention is to provide a secondary cooling method and a secondary cooling device for continuous casting that improve cooling performance of secondary cooling in a continuous casting machine, and are adaptable to an increase in casting speed, without significantly increasing an amount of water or extending a machine length of the continuous casting machine.

Solution to Problem

In order to solve the above problems, in the present invention, improving cooling efficiency of a casting product while ensuring uniformity of cooling has been contemplated. As a result, it has been found that by cooling the casting product using a coolant in a stable transition boiling state, cooling efficiency can be improved without increasing an amount of the coolant, and furthermore, uniformity of cooling can be ensured. That is, the present invention relates to [1] to [10] below.

[1]

A secondary cooling method for a casting product casted in a continuous casting machine, the continuous casting machine including, in a secondary cooling zone below a mold, a plurality of pairs of support rolls that support the casting product from both sides of the casting product in a thickness direction, a cooling device being disposed between support rolls adjacent to each other along a casting direction of the continuous casting machine, the cooling device including a coolant pipe that supplies a coolant, and a coolant guide plate with a flat plate shape for spreading the coolant on the casting product, the coolant guide plate being disposed parallel to and spaced in a perpendicular direction from a surface of the casting product, the secondary cooling method including:

a step of supplying the coolant from a coolant supply port provided in the coolant guide plate to a gap between the casting product surface and the coolant guide plate, and cooling the casting product using the coolant mainly in a transition boiling region.

[2]

The secondary cooling method for a casting product in continuous casting according to [1], in which an interval between the casting product surface and the coolant guide plate is 5 mm or more, and time for the coolant to reach an upstream-side end or a downstream-side end of the coolant guide plate in the casting direction from the coolant supply port is 0.6 seconds or less.

[3]

The secondary cooling method for a casting product in continuous casting according to [1] or [2], in which the coolant supply port is a plurality of holes aligned in one row in a width direction of the casting product or a slit whose longitudinal direction is the width direction of the casting product.

[4]

The secondary cooling method for a casting product in continuous casting according to any one of [1] to [3], in which the coolant is supplied from the coolant supply port in a liquid phase, and, in a flow channel between the casting product surface and the coolant guide plate, entirely enters a gas phase before reaching an upstream-side end or a downstream-side end of the coolant guide plate in the casting direction.

[5]

The secondary cooling method for a casting product in continuous casting according to any one of [1] to [4], in which vapor of the coolant is discharged from at least one of an upstream-side end and a downstream-side end, in the casting direction, of the gap between the casting product surface and the coolant guide plate.

[6]

The secondary cooling method for a casting product in continuous casting according to any one of [1] to [5], in which quantity of heat removal by cooling for the coolant to entirely enter a gas phase before reaching an upstream-side end or a downstream-side end of the coolant guide plate in the casting direction satisfies Formula (A) below:

$$Q/W \geq 59\times10^6\ [\mathrm{J/m^3}] \quad \text{(A)},$$

where Q denotes quantity of heat removal by cooling, and W denotes water flow density.

[7]

A secondary cooling device for a casting product in continuous casting, the secondary cooling device being disposed between support rolls adjacent to each other along a casting direction, among a plurality of pairs of support rolls that support the casting product from both sides of the casting product in a thickness direction, in a secondary cooling zone below a mold of a continuous casting machine, the secondary cooling device including:

a coolant pipe that supplies a coolant; and a coolant guide plate with a flat plate shape for spreading the coolant on the casting product, the coolant guide plate being disposed parallel to and spaced in a perpendicular direction from a surface of the casting product, in which an interval between the casting product surface and the coolant guide plate is 5 mm or more, and is set in a manner that time for the coolant to reach an upstream-side end or a downstream-side end of the coolant guide plate in the casting direction from a coolant supply port provided in the coolant guide plate is 0.6 seconds or less, and the coolant is supplied from the coolant supply port to a gap between the casting product surface and the coolant guide plate, and the casting product is cooled using the coolant mainly in a transition boiling region.

[8]

The secondary cooling device for a casting product in continuous casting according to [7], further including an interval control mechanism that controls the interval between the casting product surface and the coolant guide plate.

[9]

The secondary cooling device for a casting product in continuous casting according to [7] or [8], in which the coolant supply port is a plurality of holes aligned in one row in a width direction of the casting product or a slit whose longitudinal direction is the width direction of the casting product.

[10]

The secondary cooling device for a casting product in continuous casting according to any one of [7] to [9], further including an exhaust part that discharges the coolant that has entered a gas phase from at least one of an upstream-side end and a downstream-side end, in the casting direction, of the gap between the casting product surface and the coolant guide plate.

Advantageous Effects of Invention

According to the present invention, in secondary cooling of a casting product casted in a continuous casting machine, the casting product can be cooled in a stable transition boiling region with high cooling performance, by application of a secondary cooling method for a casting product casted in a continuous casting machine and a secondary cooling device for a casting product in continuous casting of the present invention; thus, cooling efficiency of the secondary cooling can be significantly improved. This makes it possible to adapt to an increase in casting speed without increasing an amount of the coolant, and also suppress center segregation accompanying occurrence of dripping water and standing water. In addition, cooling uniformity in a width direction of the casting product can be improved, and surface cracking of the casting product accompanying temperature unevenness can be suppressed.

BRIEF DESCRIPTION OF DRAWINGS

FIG. 3 is a diagram in which FIG. 2 is viewed in a direction confronting a casting product surface.

DESCRIPTION OF EMBODIMENTS

An embodiment of the present invention is described below.

Figure 1:
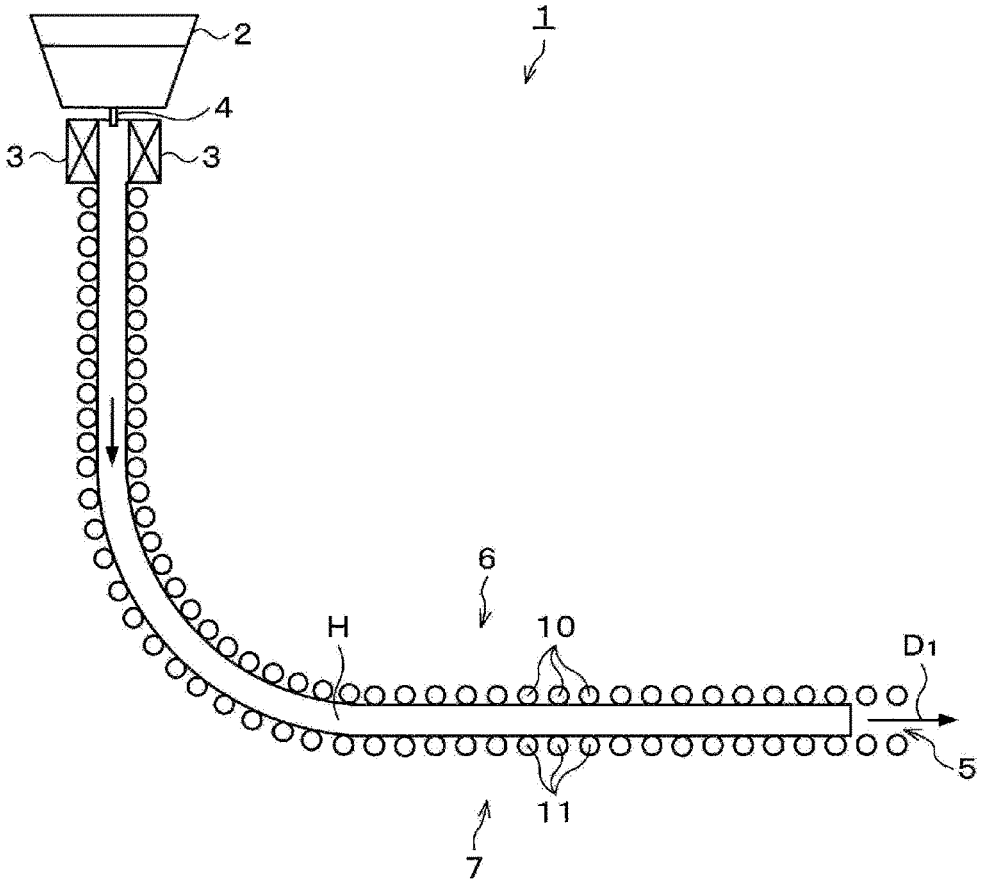
FIG. 1 is a side view illustrating an overview of a continuous casting machine according to an embodiment of the present invention.

First, an overall configuration of a continuous casting machine is described with reference to FIG. 1. FIG. 1 is an explanatory diagram schematically illustrating a configuration of a continuous casting machine 1 according to the present embodiment.

Note that types of continuous casting machines include various types. Examples include (a) a vertical type in which a mold and a support roll are arranged vertically, (b) a vertical bending type in which a casting product solidified while moving vertically is bent horizontally at a solidification completion position, (c) a curved type in which a curved mold and a support roll are arranged on arcs with the same radius and a casting product is bent back horizontally at a solidification end, (d) a vertical gradual bending type in which a mold and an upper support roll group are vertically arranged and then a casting product including unsolidified steel is gradually bent and returned to horizontal at a solidification end, and (e) a horizontal type in which a mold and a support roll are arranged horizontally. FIG. 1 illustrates an example of a continuous casting machine of a vertical gradual bending type, but the present invention is not limited to this and can be applied to any of the types of continuous casting machines.

As illustrated in FIG. 1, the continuous casting machine 1 includes a tundish 2 that temporarily stores molten steel, an immersion nozzle 4 that pours the molten steel into a mold 3 from the bottom of the tundish 2, a casting product passage 5 through which a casting product H drawn from the mold 3 is caused to pass, and a pair of roll groups 6 and 7 arranged to face each other with the casting product passage 5 therebetween.

The pair of roll groups 6 and 7 is provided on both surfaces of the casting product passage 5 to guide the casting product H in a casting direction $D_1$ along the casting product passage 5, and supports the casting product H from both sides of the casting product H in a thickness direction. The roll group 6 on the inner circumference side includes a plurality of support rolls 10 that guide the inner circumference side of the casting product H in the casting product passage 5. The support rolls 10 are arranged aligned in one row along the casting direction $D_1$, each having a central axis facing a width direction of the casting product H. The roll group 7 on the outer circumference side includes a plurality of support rolls 11 that guide the outer circumference side of the casting product H in the casting product passage 5. The support rolls 11 are arranged aligned in one row along the casting direction $D_1$, each having a central axis facing the width direction of the casting product H.

The molten steel in the tundish 2 is poured in from above the mold 3 via the immersion nozzle 4, and is subjected to primary cooling in the mold 3 to form a solidified shell at a contact surface with the mold 3. Furthermore, the casting product H having this solidified shell as an outer shell and having unsolidified molten steel inside is continuously drawn while being cooled by secondary cooling water in a state of being sandwiched by the support rolls 10 and 11 below the mold 3, and eventually the casting product H in which solidification has been completed up to a central part is produced.

Although not illustrated in FIG. 1, a secondary cooling device for a casting product in continuous casting of the present invention (a cooling device 31, see FIGS. 2 and 3) is provided in a secondary cooling zone below the mold 3, being arranged between support rolls 10 adjacent to each other along the casting direction $D_1$, and cools the casting product H. In addition, the cooling device 31 may be provided in not only a vertical part of the continuous casting machine 1 but also a curved part or a horizontal part. Applicable temperature of the cooling device 31 is from about 1100° C. (immediately below mold) to about 600° C. (horizontal part). In a continuous casting machine, immediately after start of casting (immediately below mold) is preferable as a spot to apply a secondary cooling method and a secondary cooling device for a casting product in continuous casting of the present invention, that is, water film cooling of the present invention.

First, a secondary cooling method for a casting product in continuous casting of the present invention (hereinafter also simply referred to as a secondary cooling method of the present invention) will be described, and additional description will be given as needed about a secondary cooling device for a casting product in continuous casting of the present invention (hereinafter also simply referred to as a secondary cooling device of the present invention).

The secondary cooling method for a casting product in continuous casting of the present invention includes a step of cooling a casting product using a coolant mainly in the transition boiling region. More specifically, the present invention provides a secondary cooling method for a casting product casted in a continuous casting machine. A cooling device is provided in a gap between support rolls that convey a casting product. The cooling device includes a coolant guide plate installed parallel to the casting product with a gap for forming a coolant flow channel provided between the coolant guide plate and the surface of the casting product, and a coolant pipe that supplies the coolant to the gap. The coolant supplied to the gap comes into contact with the casting product mainly in the transition boiling region to cool the casting product.

The transition boiling region is a region between the nucleate boiling region and the film boiling region, and a liquid coolant and a gaseous coolant are mixed in the transition boiling region. That is, cooling a casting product (also referred to as a steel slab) in the transition boiling region refers to cooling the casting product by a coolant coming into contact with the casting product surface in a state where a three-phase interface of a solid casting product (solid phase), a liquid coolant (liquid phase), and a gaseous coolant (gas phase) is formed. In the present invention, a coolant is mainly water.

Note that "Maximum heat flux propagation velocity during quenching by water jet impingement", International Journal of Heat and Mass Transfer 50 (2007), 1559-1568, for example, describes that a steel slab can be strongly cooled, that is, the heat transfer coefficient is improved, when the steel slab is cooled in the transition boiling region.

Figure 4:
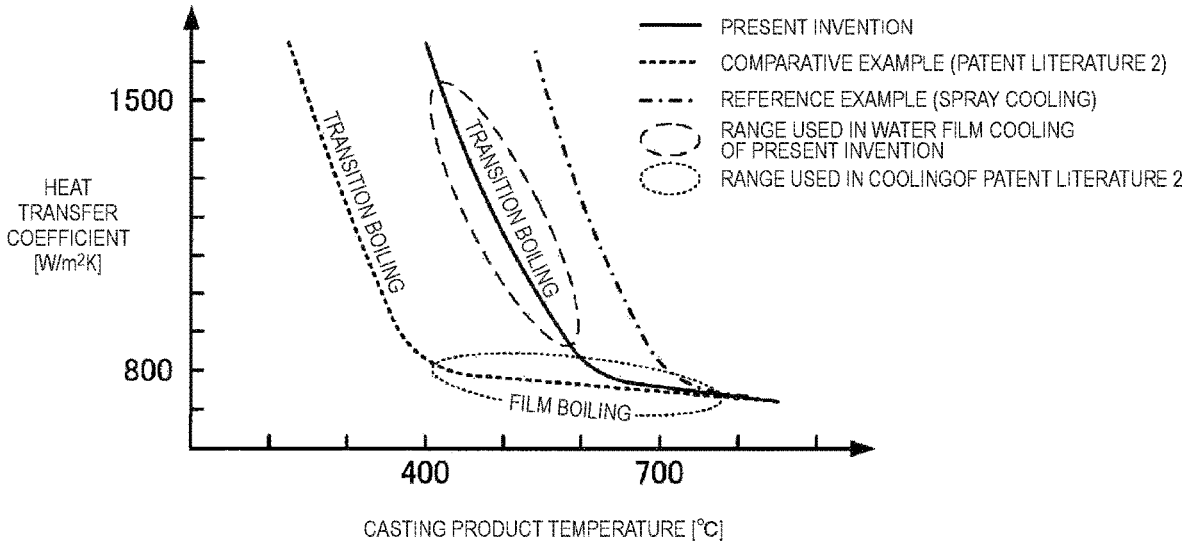
FIG. 4 shows the relationship between surface temperature of a casting product and a heat transfer coefficient during secondary cooling. A solid line indicates the heat transfer coefficient in water film cooling of the present invention, a dotted line indicates the heat transfer coefficient in water film cooling disclosed in Patent Literature 2, and a broken line indicates the heat transfer coefficient in spray cooling. Moreover, heat transfer coefficient ranges used in water film cooling of the present invention and Patent Literature 2 are also shown.

Here, the secondary cooling method for a casting product in continuous casting of the present invention is described with reference to FIG. 4. Cooling using water film flow mainly in the transition boiling region, which is the secondary cooling method of the present invention, is water film cooling using the stable transition boiling region (also referred to as water film cooling of the present invention, or three-phase-interface water film cooling). In FIG. 4, the horizontal axis represents surface temperature of the casting product, and the vertical axis represents a heat transfer coefficient. FIG. 4 shows water film cooling in the transition boiling region in the present invention, and water film cooling in the film boiling region disclosed in Patent Literature 2 described above, as a comparative example. Note that FIG. 4 also shows conventional spray-type cooling as a reference example.

In water film cooling disclosed in Patent Literature 2, which is the comparative example, cooling is performed in the film boiling region in which the heat transfer coefficient is low, and not in the transition boiling region. Since the casting product is cooled by cooling water from the plurality of ejection holes (ejection holes in a staggered arrangement) formed aligned in the longitudinal direction of the casting product, a stable cooling region and an unstable cooling region are mixed on a cooling surface of the casting product as described above, resulting in unstable cooling of the casting product. Moreover, in water film cooling disclosed in Patent Literature 2, since the ejection holes have a staggered arrangement, temperature unevenness due to overcooling occurs in the transition boiling region, being accompanied by cracking. Therefore, the casting product is cooled only in the film boiling region by contriving collision water pressure so as to prevent occurrence of the transition boiling state.

In contrast, in water film cooling of the present invention, a casting product is cooled using a coolant mainly in the transition boiling region. "Mainly in the transition boiling region" means that 80% or more of a flow channel is in the transition boiling state, and the rest is mainly the non-boiling region and/or the nucleate boiling region. Basically, a coolant in the film boiling region is not used for cooling, but may exist in the flow channel in a range of 10% or less. Here, the "flow channel" is a region in which the coolant flows substantially in a casting direction through a gap between the casting product and the coolant guide plate, from a coolant supply port to an upstream-side end or a downstream-side end of the coolant guide plate in the casting direction. Note that the coolant guide plate is provided to be parallel to the casting product. Here, "parallel" means substantially parallel, and allows deviation from a plane completely parallel to the casting product surface to the extent that the present invention is implementable.

The transition boiling region in the present invention is a region in which the heat transfer coefficient is high, and thus can improve cooling efficiency. In water film cooling of the present invention, the coolant supplied to the gap between the casting product and the coolant guide plate comes into contact with the casting product in the transition boiling region, and evaporates before entering the film boiling region. Thus, the coolant cools the casting product mainly in a state of only the transition boiling region and evaporates, without entering film boiling, which prevents unstable cooling. Therefore, in the present invention, the casting product can be cooled in a stable transition boiling region with high cooling performance. Note that 800 $W/m^2 \cdot K$ or more is preferable, as will be described later, as the high heat transfer coefficient in this transition boiling region.

In addition, since the casting product is thus cooled in a stable transition boiling region in the present invention, cooling uniformity in the width direction of the casting product can be improved, which can suppress temperature unevenness of the casting product surface. As a result, surface cracking of the casting product accompanying temperature unevenness can be suppressed.

Furthermore, since water film cooling in the transition boiling region is performed in the present invention, cooling efficiency rises, enabling an amount of the coolant to be reduced to a small amount. Moreover, since the amount of the coolant is an amount that evaporates in the transition boiling region, occurrence of dripping water and standing water in the conventional spray type, which is a problem in Patent Literature 1, and center segregation accompanying that can be suppressed.

It is preferable that the gap (an interval between the coolant guide plate and the surface of the casting product) be 5 mm or more and make time for passage of the coolant in the flow channel 0.6 seconds or less. Note that normally, half of the coolant supplied from the supply port flows to the upstream side, and the other half flows to the downstream side. Therefore, a distance for which the coolant passes on the casting product is a length, in a conveyance direction of the casting product, from the supply port to the upstream-side end or the downstream-side end of the coolant guide plate in the casting direction. That is, time for passage of the coolant in the flow channel is time for the coolant to pass through the length, in the conveyance direction of the casting product, from the supply port to the upstream-side end or the downstream-side end of the coolant guide plate in the casting direction.

Time for passage of the coolant in the flow channel being 0.6 seconds or less translates into a ratio (Q/W) of quantity of heat removal by cooling (Q) to water flow density (W) of the coolant, that is, quantity of heat given from the casting product for the coolant to entirely evaporate. As will be described later, in the case where the coolant is water, the ratio (Q/W) of quantity of heat removal by cooling (Q) in water film cooling to water flow density (W) of the coolant needs to be $59\times10^6$ J/m$^3$ or more for the coolant to evaporate in the transition boiling region.

The interval of the gap is preferably 9 mm or less. If the interval is greater than 9 mm, the coolant remains as a liquid phase without completely evaporating; thus, the casting product is cooled by the coolant in the film boiling region, and an improvement in cooling efficiency cannot be expected. In addition, if the interval of the gap is less than 5 mm, since the casting product surface and the coolant guide plate are close to each other, scale caused on the steel slab surface by cooling, or a bend or bulging of the steel slab caused by cooling may cause the coolant guide plate and the casting product to come into contact with each other, which is not practical.

Time for passage of the coolant in the flow channel is preferably 0.3 seconds or more. If the time for passage is less than 0.3 seconds, the coolant passes through the flow channel before entering the transition boiling region, that is, the casting product is cooled by the coolant in the non-boiling region or the nucleate boiling region; hence, an improvement in cooling efficiency, cannot be expected.

The coolant is supplied to the gap via the supply port formed in the coolant guide plate. The supply port is preferably a plurality of holes aligned in one row in the width direction of the casting product or a slit whose longitudinal direction is the width direction of the casting product.

Meanwhile, in the water film cooling disclosed in Patent Literature 2 described above, since the plurality of ejection holes are formed in the longitudinal direction of the casting product (that is, the ejection holes have a staggered arrangement), unlike in the present invention, a stable cooling region and an unstable cooling region are mixed on a cooling surface of the casting product as described above, resulting in unstable cooling of the casting product. Therefore, in the method disclosed in Patent Literature 2, cracking due to temperature unevenness occurs when a coolant in the transition boiling region is used. To avoid such cracking, the water film cooling disclosed in Patent Literature 2 is a cooling method utilizing the film boiling region.

In contrast, in the present invention, since there is one supply port in the longitudinal direction of the casting product, cooling in a stable transition boiling region can be achieved in the entire region on the cooling surface of the casting product. In addition, since the supply port in the present invention is a plurality of holes aligned in one row in the width direction of the casting product or a slit whose longitudinal direction is the width direction of the casting product, the coolant is supplied uniformly in the width direction of the casting product from the supply port. Therefore, cooling uniformity in the width direction of the casting product can be further improved.

In the present invention, the coolant supplied to the gap between the coolant guide plate and the casting product preferably comes into contact with and cools the casting product in the transition boiling region and entirely evaporates before entering the film boiling region. Moreover, vapor of the coolant is preferably discharged from at least one of the upstream-side end and the downstream-side end of the gap in the casting direction.

In the present invention, the coolant supplied to the gap comes into contact with the casting product mainly in the transition boiling region and evaporates, and the casting product is not cooled in the film boiling region in which the heat transfer coefficient is low. Moreover, actively discharging the vapor of the coolant makes it possible to more reliably prevent the coolant from coming into contact with the casting product in the film boiling region. Therefore, the casting product can be cooled in a further stable transition boiling region.

Figure 2:
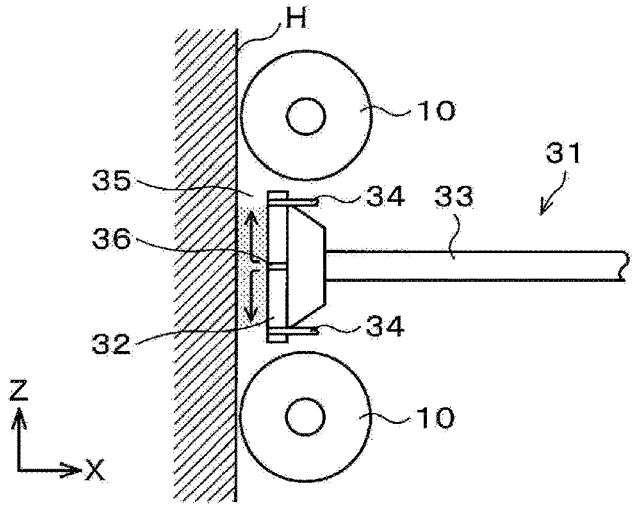
FIG. 2 is a side view illustrating part of a continuous casting machine including a cooling device according to an embodiment of the present invention.
Figure 3:
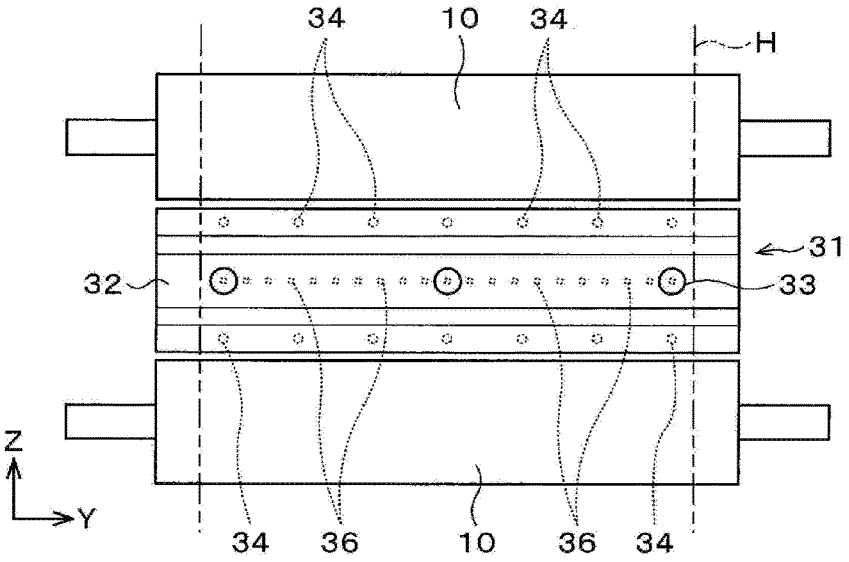

Next, a configuration of a secondary cooling device according to an embodiment of the present invention is described with reference to FIGS. 2 and 3.

The cooling device 31, which is one embodiment of the present invention, includes a coolant guide plate 32 whose longitudinal direction is the width direction of the casting product H, and a water supply pipe 33 serving as a coolant pipe that supplies a coolant, and is supported by a support mechanism (not illustrated). The coolant guide plate 32 has a flat plate shape, and can spread the coolant on the casting product.

In the cooling device 31, an exhaust pipe 34, which is an exhaust part, is preferably provided to penetrate the coolant guide plate 32, at both an upstream-side (mold-side) end and a downstream-side end of a water supply port 36 in the casting direction. The exhaust pipe 34 may be a plurality of round holes with a diameter of approximately 5 mm aligned in one row in the width direction of the casting product H, as illustrated in FIG. 3, for example. Vapor of cooling water is discharged from the exhaust pipe 34.

Although the exhaust pipe 34 is provided at both ends on the upstream side and the downstream side of a gap 35 in the casting direction, it may be provided at either one of the ends. Furthermore, the exhaust pipe 34 may be omitted, but it is preferable to provide the exhaust pipe 34 and actively discharge vapor in order to perform water film cooling of the present invention (three-phase-interface water film cooling of the present invention) to ensure high cooling performance.

In such a cooling device 31, half of cooling water supplied from the water supply pipe 33 to the gap 35 via the water supply port 36 flows to the upstream side, and the other half flows to the downstream side. Then, the cooling water becomes water film flow in the gap 35, and cools the surface of the casting product H in the transition boiling region. That is, the casting product H is strongly cooled by utilizing the three-phase interface. The cooling water that has flowed through the gap 35 undergoes the transition boiling region and becomes vapor before entering the film boiling region, and is discharged from the exhaust pipe 34 at the upstream-side end and the downstream-side end of the gap 35 in the casting direction.

The coolant guide plate 32 is disposed parallel to the surface of the casting product H with an interval (gap 35) provided in a perpendicular direction to the surface of the casting product H, and is installed in the cooling device 31 in a manner that the interval of the gap 35 is adjustable. The coolant guide plate 32 is configured to spread the coolant on the casting product, and its shape is a flat plate shape. Here, the gap 35 between the coolant guide plate 32 and the surface of the casting product H serves as a coolant flow channel. Note that this "parallel" means being substantially parallel to the surface of the casting product H.

In a central part of the coolant guide plate 32 is formed a coolant supply port (the water supply port 36 in FIGS. 2 and 3), and the coolant is supplied from the supply port to the gap (gap 35) between the surface of the casting product H and the coolant guide plate 32. The water supply port 36 is preferably a plurality of round holes with a diameter of approximately 5 mm as illustrated in FIG. 3, for example, or one slit or a plurality of slits whose longitudinal direction is the width direction of the casting product H. However, the plurality of round holes or the plurality of slits need to be aligned in one row in the width direction of the casting product H.

Furthermore, an exhaust part (for example, the exhaust pipe 34 in FIG. 3) for discharging the coolant that has entered a gas phase is preferably provided at one of the upstream-side end and the downstream-side end of the coolant guide plate 32 in the casting direction.

Moreover, it is preferable that the interval (gap 35) between the surface of the casting product H and the coolant guide plate 32 be 5 mm or more, and time for the coolant to reach the upstream-side end or the downstream-side end of the coolant guide plate 32 in the casting direction from the supply port (water supply port 36) be 0.6 seconds or less.

Hence, the interval of the gap 35 is preferably controlled by an interval control mechanism (not illustrated). The interval control mechanism includes a distance meter (not illustrated) that measures, for example, the interval of the gap 35, that is, a distance between the surface of the casting product H and the coolant guide plate 32. Here, bulging of the casting product H changes in the casting direction, and a thickness of the gap 35 may go out of a predetermined range (equal to or more than 5 mm and equal to or less than 9 mm). Hence, the interval of the gap 35, that is, a height of the coolant flow channel, is constantly measured by the distance meter, and in the case where the interval of the gap 35 goes out of the predetermined range, an installation position of the coolant guide plate 32 is adjusted to control the thickness of the gap 35. In such a case, the thickness of the gap 35 can be constantly maintained in the predetermined range, and cooling can be performed in a stable transition boiling region with high cooling performance. Note that an alert may be issued in the case where the interval of the gap 35 goes out of the predetermined range.

In the present embodiment, the casting product H can be cooled in a stable transition boiling region in which the heat transfer coefficient is high. Furthermore, since there is one water supply port 36 in the longitudinal direction of the casting product H, cooling in a stable transition boiling region can be achieved in the entire region on the cooling surface of the casting product H.

In addition, since the water supply port 36 is a plurality of round holes aligned in one row in the width direction of the casting product H, one slit whose longitudinal direction is the width direction of the casting product H, or a plurality of slits aligned in one row in the width direction, the cooling water is supplied uniformly in the width direction from the water supply port 36. Therefore, cooling uniformity in the width direction of the casting product H can be improved.

Moreover, actively discharging the vapor of the cooling water in the gap 35 makes it possible to more reliably prevent the cooling water from coming into contact with the casting product H in the film boiling region. In other words, the casting product H can be cooled in a stable transition boiling region, without being cooled in a region in which the heat transfer coefficient is low.

Note that in water film cooling of the present invention, water flow density is preferably approximately the maximum value of suppliability of a cooling water pump in an existing continuous casting machine. An increase in water flow density may require installation of a new cooling water pump, leading to an excessive amount of capital investment, which is not practical in some cases.

In addition, since the cooling device 31 is disposed between the support rolls 10 adjacent to each other along the casting direction of the continuous casting machine 1, a length of the coolant guide plate 32 is approximately a length of an interval between the support rolls 10 at maximum. For example, in the case where the interval between the support rolls 10 is about 200 mm to 250 mm, the length of the coolant guide plate 32 is about 200 mm.

The preferred embodiment(s) of the present invention has/have been described above, whilst the present invention is not limited to the above examples. A person skilled in the art may find various alterations and modifications within the scope of the appended claims, and it should be understood that they will naturally come under the technical scope of the present invention.

[Experimental Results]

Figure 5:
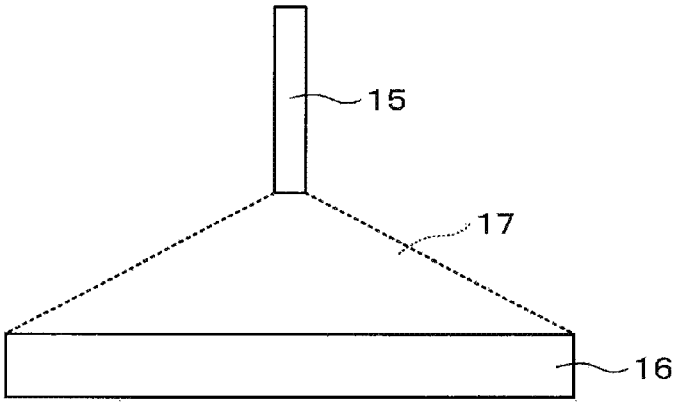
FIG. 5 is a cross-sectional diagram schematically illustrating an experiment device for testing cooling performance of spray cooling.

First, a heat transfer coefficient of a steel slab when secondary cooling by conventional spray-type cooling was performed was measured. FIG. 5 illustrates an experiment device that measures cooling performance of a spray nozzle 15 typically used in current continuous casting machines. From above a central part of a steel slab 16 heated in advance to a temperature equal to or greater than a predetermined evaluation temperature, cooling water was jetted to the steel slab surface using various nozzles to cool the steel slab 16. A shift of temperature of the steel slab 16 during cooling was measured, and a heat transfer coefficient of the steel slab surface was obtained using the measurement result. At this time, a shift of temperature of a portion of the steel slab surface where a spray jet 17 of cooling water from the spray nozzle 15 did not collide directly was also measured. An average value across a range of a rectangle in which is inscribed an ellipse formed by the spray jet 17 of cooling water ejected from the spray nozzle 15 colliding with the steel slab surface was calculated as a heat transfer coefficient when the spray nozzle 15 was used. Temperature measurement of the steel slab 16 was performed by embedding a thermocouple in a position 2 mm inside from a cooling surface of the steel slab 16 in a thickness direction.

Table 1 shows measured values of the heat transfer coefficient when the evaluation temperature was set to 900° C. Water flow density was set to 1000 L/min·m$^2$ and 500 L/min·m$^2$. Here, water flow density is obtained by dividing the amount of cooling water jetted from the spray nozzle by an area of the rectangle on the steel slab. Note that the measured values of the heat transfer coefficient shown in Table 1 are heat transfer coefficients in conventional typical spray cooling, and serve as reference values in describing an effect of the present invention later.

TABLE 1

<Conventional typical spray cooling>

| Experiment level | Evaluation temperature (° C.) | Water flow density (L/min · m$^2$) | Heat transfer coefficient (W/m$^2$ · K) | |
|---|---|---|---|---|
| 1-1 | 900 | 1000 | 713 | reference example |
| 1-2 | 900 | 500 | 498 | reference example |

Figure 6:
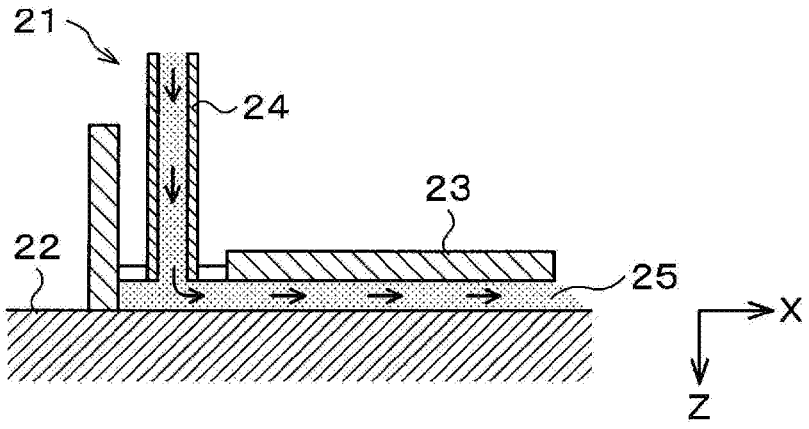
FIG. 6 is a cross-sectional diagram schematically illustrating an experiment device for testing cooling performance of water film cooling.

Next, a cooling effect of water film cooling, which is cooling using the cooling device of the present invention, was tested. FIG. 6 schematically illustrates a model device 21 for testing cooling performance of water film cooling. A coolant guide plate 23 was provided appropriately spaced from the surface of a steel slab 22, and water was supplied from a water supply nozzle 24 toward a gap 25 between the steel slab 22 and the coolant guide plate 23. The gap 25 served as a cooling water flow channel, and a water film was formed on the surface of the steel slab 22 to cool the steel slab 22. Temperature of the steel slab 22 depending on a distance from the water supply nozzle 24 in a direction in which cooling water flows (X direction) was measured, and cooling performance was checked. Temperature measurement of the steel slab 22 was performed by embedding a thermocouple in a position 1.5 mm inside from a cooling surface of the steel slab 22 in a thickness direction (Z direction).

Tables 2 to 5 show measured values of the heat transfer coefficient obtained by water film cooling when the evaluation temperature was set to 900° C. Tables 2 and 3 show a case where water flow density was set to 1000 L/min·m$^2$, and Tables 4 and 5 show a case where water flow density was set to 500 L/min·m$^2$. Here, water flow density is obtained by dividing the amount of cooling water supplied per unit time from a supply port, that is, a water supply port, to form water film flow by an area of the steel slab. In addition, Tables 2 and 4 show a case where a flow channel gap interval (also referred to as an interval between the surface of the steel slab and the coolant guide plate) was set to less than 5 mm, and Tables 3 and 5 show a case where the flow channel gap interval was set to 5 mm or more. In the experiment of water film cooling, a range in which a water film was formed on the steel slab surface was treated as an evaluation target area.

In addition, a maximum value of water flow density in the experiment of water film cooling was set to 1000 L/min·m$^2$.

In addition, as shown in Tables 2 and 4, a minimum value of the interval between the steel slab surface and the coolant guide plate (flow channel gap interval) was set to 0.6 mm in the experiment of water film cooling. At a level where the coolant guide plate and the steel slab was brought as close to each other as a flow channel gap interval of 0.5 mm, the steel slab was not able to be cooled, and the heat transfer coefficient was not able to be measured. This is estimated to be because scale caused on the steel slab surface by cooling or a bend of the steel slab caused by cooling has blocked the cooling water flow channel.

In addition, immediately after start of casting, an interval between support rolls is about 200 mm to 250 mm. In the case of installing a coolant guide plate for water film cooling between the support rolls, a length of the coolant guide plate is presumed to be about 200 mm. It was assumed that water serving as a coolant is supplied from a central part of the coolant guide plate, and half of the supplied cooling water flows upward (to the mold side) and the other half flows downward. Therefore, a length of the water film flow was set to 100 mm in this test.

Figure 7:
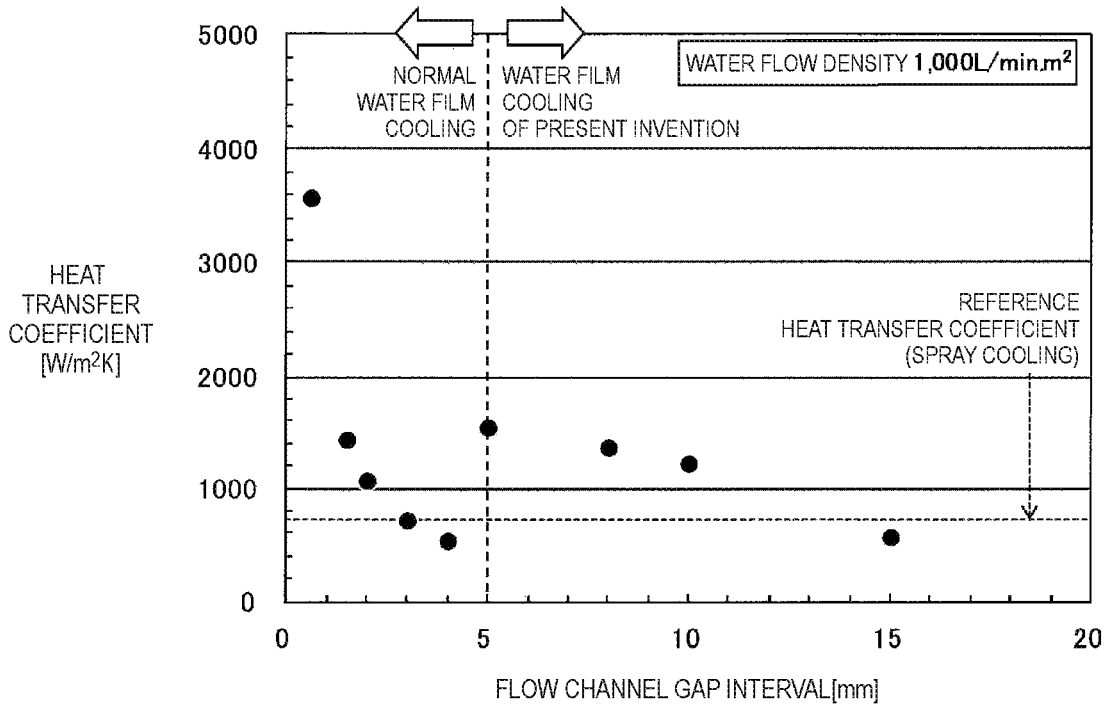
FIG. 7 is a graph showing a heat transfer coefficient in water film cooling when water flow density is 1000 $L/min \cdot m^2$ with respect to a flow channel gap interval. The heat transfer coefficient measured by the experiment device in FIG. 6 is compared with the heat transfer coefficient in spray cooling measured by the experiment device in FIG. 5.

First, description is given on a case where water flow density is 1000 L/min·m$^2$ shown in Tables 2 and 3. In FIG. 7, the heat transfer coefficients obtained by water film cooling when water flow density is 1000 L/min·m$^2$ are plotted with the horizontal axis representing the flow channel gap interval, that is, the heat transfer coefficients shown in Tables 2 and 3 are plotted. In addition, a dotted line in FIG. 7 indicates the measurement value of the heat transfer coefficient obtained by spray cooling, 713 W/m$^2$·K, shown in Table 1.

According to FIG. 7, a fluctuation tendency of the heat transfer coefficient changes at a threshold of a flow channel gap interval of 5 mm. Therefore, cooling at a flow channel gap interval of less than 5 mm as shown in Table 2 is normal water film cooling, and cooling at a flow channel gap interval of 5 mm or more as shown in Table 3 is three-phase-interface water film cooling. Note that this three-phase-interface water film cooling is water film cooling using the stable transition boiling region of the present invention.

Figure 8:
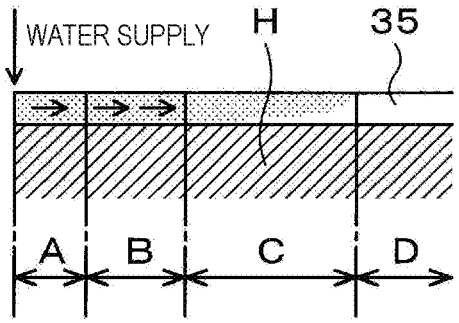
FIG. 8 is a diagram for describing a change in the state of water that comes into contact with a casting product in water film cooling.

Here, in the case of performing water film cooling, cooling performance with respect to the casting product is presumed to differ greatly, depending on a state of cooling water that comes into contact with the casting product (steel slab). That is, in general, cooling water comes into contact with the hot casting product H at a water supply spot, and enters the states of non-boiling (section A), nucleate boiling (section B), transition boiling (section C), and film boiling (section D) in sequence, as illustrated in FIG. 8. Normal water film cooling and three-phase-interface water film cooling, with changed flow channel gap intervals, differ from each other in the lengths of these sections A to D.

It was found from Table 2 and FIG. 7 that in normal water film cooling, a reduction in flow channel gap interval improves the heat transfer coefficient. This is because when the flow channel gap interval is reduced, flow speed of a water film flowing between the steel slab and the coolant guide plate rises, and a length of the non-boiling region (section A) to the nucleate boiling region (section B), in which the cooling effect is high, becomes longer in the flow channel gap. Thus, in normal water film cooling, a reduction in flow channel gap interval leads to an increase in heat transfer coefficient, in other words, an increase in flow channel gap interval leads to a decrease in heat transfer coefficient.

Meanwhile, according to Table 3 and FIG. 7, when the flow channel gap interval is increased to 5 mm, that is, in three-phase-interface water film cooling, the heat transfer coefficient increases. This is because when the flow channel gap interval is increased to 5 mm, flow speed of the water film flowing between the steel slab and the coolant guide plate is reduced, and a length of the transition boiling region (section C) becomes longer in the flow channel gap.

In addition, in three-phase-interface water film cooling, in the flow channel gap, the cooling water undergoes the transition boiling region (section C) and then evaporates before entering the film boiling region (section D). That is, the cooling water does not come into contact with the steel slab in the film boiling region (section D). Thus, the coolant cools the steel slab mainly in a state of only the transition boiling region and evaporates, without entering film boiling, which prevents unstable cooling. Therefore, cooling in a stable transition boiling region with high cooling performance can be achieved.

Furthermore, since the cooling water is supplied to the flow channel gap from water supply ports of the coolant guide plate aligned in one row in the width direction of the steel slab, cooling can be performed only in a stable cooling region on a cooling surface of the steel slab. This enables more stable cooling.

According to Table 3 and FIG. 7, when the flow channel gap interval is increased from 5 mm, the heat transfer coefficient decreases, but the heat transfer coefficient at a flow channel gap interval of up to 10 mm is larger than the heat transfer coefficient in spray cooling. However, in the case where the flow channel gap interval is further increased to 15 mm, the measured heat transfer coefficient is below the value of spray cooling, which indicates that the heat transfer coefficient is not improved as compared with spray cooling even if water film cooling is introduced. Therefore, the flow channel gap interval of 15 mm falls outside the range of the present invention. The reason why the heat transfer coefficient is thus not improved is presumably because when the flow channel gap interval is increased, flow speed of the water film flowing between the steel slab and the coolant guide plate is reduced, and the length of the film boiling region (section D) becomes longer in the flow channel gap, so that a cooling effect provided by a three-phase interface cannot be enjoyed. Note that in Table 3, as a determination result of a condition for superiority of water film cooling over spray cooling, A is entered for a level of a condition under which the heat transfer coefficient in water film cooling is equal to or greater than the heat transfer coefficient in spray cooling, and B is entered for a level of a condition under which the heat transfer coefficient in water film cooling is smaller than in spray cooling or cooling cannot be performed by water film cooling.

Thus, it can be understood from Tables 2 and 3 and FIG. 7 that at a water flow density of 1000 L/min·m$^2$, cooling by water film cooling of the present invention can be performed if the flow channel gap interval is in a range of 5 mm to 10 mm, under the experimental conditions.

Figure 9:
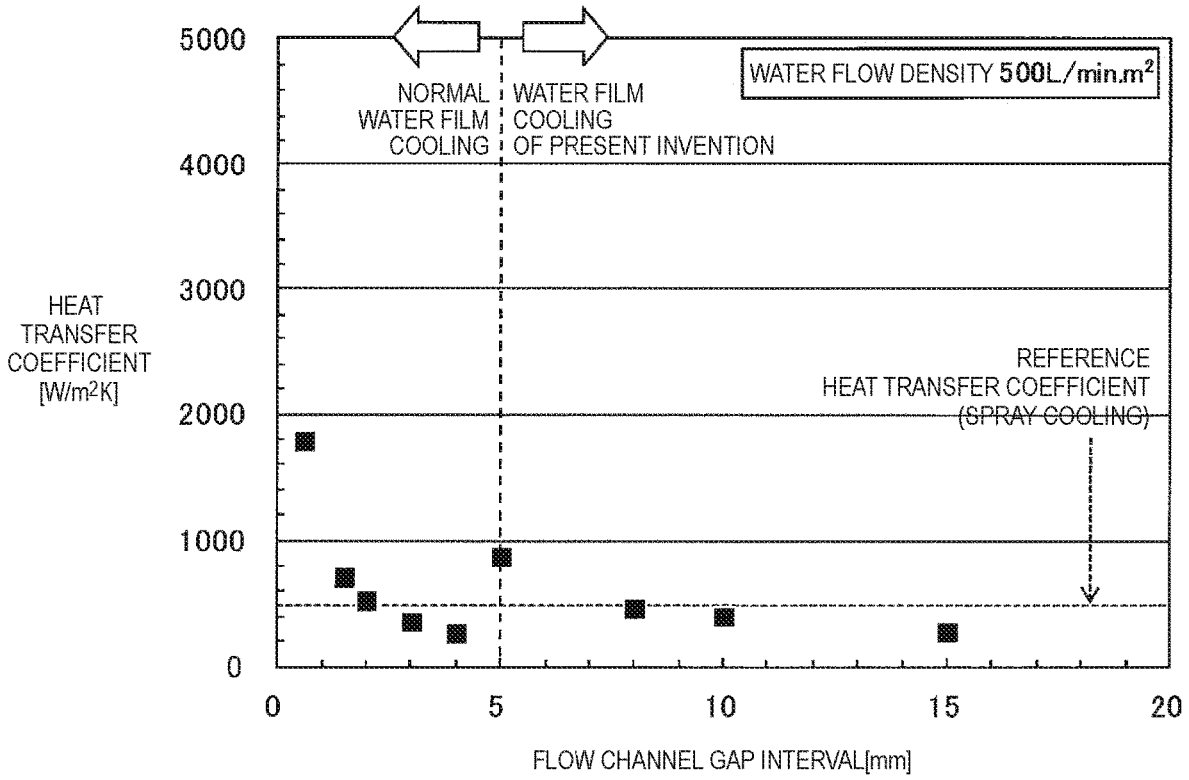
FIG. 9 is a graph showing a heat transfer coefficient in water film cooling when water flow density is 500 $L/min \cdot m^2$ with respect to a flow channel gap interval. The heat transfer coefficient in water film cooling measured by the experiment device in FIG. 6 is compared with the heat transfer coefficient in spray cooling measured by the experiment device in FIG. 5.

Next, description is given on a case where water flow density is 500 L/min·m$^2$ shown in Tables 4 and 5. In FIG. 9, the heat transfer coefficients obtained by water film cooling when water flow density is 500 L/min·m$^2$ are plotted with the horizontal axis representing the flow channel gap interval, that is, the heat transfer coefficients shown in Tables 4 and 5 are plotted. In addition, a dotted line in FIG. 9 indicates the measurement value of the heat transfer coefficient obtained by spray cooling, 498 W/m$^2$·K, shown in Table 1.

Also at a water flow density of 500 L/min·m$^2$, a fluctuation tendency of the heat transfer coefficient changes at a threshold of a flow channel gap interval of 5.0 mm, like at a water flow density of 1000 L/min·m$^2$ described above. That is, the steel slab is cooled by normal water film cooling at a flow channel gap interval of less than 5.0 mm as shown in Table 4, and the steel slab is cooled by three-phase-interface water film cooling at a flow channel gap interval of 5.0 mm or more as shown in Table 5. Note that at the same flow channel gap interval, the heat transfer coefficient when water flow density is 500 L/min·m$^2$ is smaller than the heat transfer coefficient when water flow density is 1000 L/min·m$^2$.

According to Table 5 and FIG. 9, when the flow channel gap interval is increased from 5 mm, the heat transfer coefficient decreases. At a flow channel gap interval of 8 mm, the measured heat transfer coefficient is below the value of spray cooling, which indicates that the heat transfer coefficient is not improved as compared with spray cooling even if water film cooling is introduced. Therefore, a flow channel gap interval of 8 mm or more falls outside the range of the present invention. The reason why the heat transfer coefficient is thus not improved is similar to that in the case where water flow density is 1000 L/min·m$^2$; thus, description is omitted. Note that in Table 5, as a determination result of a condition for superiority of water film cooling over spray cooling, A is entered for a level of a condition under which the heat transfer coefficient in water film cooling is equal to or greater than the heat transfer coefficient in spray cooling, and B is entered for a level of a condition under which the heat transfer coefficient in water film cooling is smaller than in spray cooling or cooling cannot be performed by water film cooling.

Thus, it can be understood from Tables 4 and 5 and FIG. 9 that at a water flow density of 500 L/min·m$^2$, cooling by water film cooling of the present invention can be performed if the flow channel gap interval is 5 mm, under the experimental conditions.

According to the above description, in both cases where water flow density is 1000 L/min·m$^2$ and water flow density is 500 L/min·m$^2$, high cooling performance utilizing a three-phase interface (transition boiling region) can be obtained at a flow channel gap interval of 5 mm or more. Moreover, according to Tables 3 and 5 and FIGS. 7 and 9, 800 W/m$^2$·K or more is preferable as the heat transfer coefficient of this high cooling performance utilizing a three-phase interface (transition boiling region). In addition, since high cooling performance can thus be obtained even if the flow channel gap interval is large, the cooling device of the present invention can be easily installed in the continuous casting machine 1, and flexibility in installation can be enhanced.

In addition, according to Tables 3 and 5, an upper limit of the flow channel gap interval for performing water film cooling of the present invention (three-phase-interface water film cooling) can be defined by time needed for cooling water to pass through a flow channel (water film cooling section). Specifically, high cooling performance utilizing a three-phase interface can be obtained when the time for passage is 0.6 seconds or less.

This time for passage of the cooling water in the flow channel translates into a ratio (Q/W) of quantity of heat removal by cooling (Q) to water flow density (W) of the cooling water. Specifically, Q/W can be calculated by Formula (1) below. In Formula (1), "α" of the right term denotes a heat transfer coefficient. In addition, "900" of the right term is based on the evaluation temperature being 900° C., and "100" is based on the temperature of the cooling water being about 100° C.

$$Q/W=\alpha(900-100)/W \quad (1)$$

According to Tables 3 and 5, when this Q/W is $59\times10^6$ J/m$^3$ or more, cooling (water film cooling of the present invention) mainly utilizing a three-phase interface (transition boiling region) can be performed. Meanwhile, when Q/W is less than $59\times10^6$ J/m$^3$, cooling is performed in the film boiling region, so that a cooling effect provided by a transition boiling region cannot be enjoyed. Therefore, time for passage of the cooling water in the flow channel being 0.6 seconds or less translates into Q/W being $59\times10^6$ J/m$^3$ or more, which is quantity of heat removal by cooling for the coolant to entirely evaporate in the transition boiling region. However, even if Q/W is $59\times10^6$ J/m$^3$ or more, in the case where time for passage of the cooling water is less than 0.3 seconds, the cooling water passes through the flow channel before entering the transition boiling region, that is, in the non-boiling region and/or the nucleate boiling region, so that a cooling effect provided by a transition boiling region with high cooling performance cannot be enjoyed; hence, this case is not included in the present invention. Alternatively, even if Q/W is $59\times10^6$ J/m$^3$ or more, in the case where the flow channel gap interval is less than 5 mm, since the gap between the steel slab surface and the coolant guide plate is very narrow, scale caused on the steel slab surface by cooling, or a bend or bulging of the steel slab caused by cooling may cause the coolant guide plate and the steel slab to come into contact with each other; hence, this case is not included in the present invention.

TABLE 2

<Normal water film cooling>

| Experiment level | Evaluation temperature (° C.) | Water flow density W (L/min · m$^2$) | Evaluation length (mm) | Flow channel gap interval (mm) | Flow speed (m/s) | Time for passage (sec) | Heat transfer coefficient α (W/m$^2$ · K) | Q/W (J/m$^3$) | Boiling region of coolant | |
|---|---|---|---|---|---|---|---|---|---|---|
| 2-1 | 900 | 1000 | 100 | 0.6 | 2.78 | 0.04 | 3580 | $172\times10^6$ | non-boiling region and nucleate boiling region | reference example |
| 2-2 | 900 | 1000 | 100 | 1.5 | 1.11 | 0.09 | 1436 | $69\times10^6$ | non-boiling region and nucleate boiling region | reference example |
| 2-3 | 900 | 1000 | 100 | 2 | 0.83 | 0.12 | 1073 | $52\times10^6$ | non-boiling region and nucleate boiling region | reference example |
| 2-4 | 900 | 1000 | 100 | 3 | 0.56 | 0.18 | 722 | $35\times10^6$ | non-boiling region and nucleate boiling region | reference example |
| 2-5 | 900 | 1000 | 100 | 4 | 0.42 | 0.24 | 537 | $26\times10^6$ | non-boiling region and nucleate boiling region | reference example |

TABLE 3

<Water film cooling of present invention>

| Experiment level | Evaluation temperature (° C.) | Water flow density W (L/min · m$^2$) | Evaluation length (mm) | Flow channel gap interval (mm) | Flow speed (m/s) | Time for passage (sec) | Heat transfer coefficient α (W/m$^2$ · K) | Q/W (J/m$^3$) | Water film cooling superiority condition (over spraying) | Boiling region of coolant | |
|---|---|---|---|---|---|---|---|---|---|---|---|
| 3-1 | 900 | 1000 | 100 | 5 | 0.33 | 0.3 | 1545 | $74\times10^6$ | A | transition boiling region | invention example |
| 3-2 | 900 | 1000 | 100 | 8 | 0.21 | 0.48 | 1368 | $66\times10^6$ | A | transition boiling region | invention example |
| 3-3 | 900 | 1000 | 100 | 10 | 0.17 | 0.6 | 1225 | $59\times10^6$ | A | transition boiling region | invention example |
| 3-4 | 900 | 1000 | 100 | 15 | 0.11 | 0.9 | 570 | $27\times10^6$ | B | film boiling region | comparative example |

TABLE 4

<Normal water film cooling>

| Experiment level | Evaluation temperature (° C.) | Water flow density W (L/min · m$^2$) | Evaluation length (mm) | Flow channel gap interval (mm) | Flow speed (m/s) | Time for passage (sec) | Heat transfer coefficient α (W/m$^2$ · K) | Q/W (J/m$^3$) | Boiling region of coolant | |
|---|---|---|---|---|---|---|---|---|---|---|
| 4-1 | 900 | 500 | 100 | 0.6 | 1.39 | 0.07 | 1790 | $222\times10^6$ | non-boiling region and nucleate boiling region | reference example |

TABLE 4-continued

<Normal water film cooling>

| Experiment level | Evaluation temperature (° C.) | Water flow density W (L/min · $m^2$) | Evaluation length (mm) | Flow channel gap interval (mm) | Flow speed (m/s) | Time for passage (sec) | Heat transfer coefficient α (W/$m^2$ · K) | Q/W (J/$m^3$) | Boiling region of coolant | |
|---|---|---|---|---|---|---|---|---|---|---|
| 4-2 | 900 | 500 | 100 | 1.5 | 0.56 | 0.18 | 715 | $89 \times 10^6$ | non-boiling region and nucleate boiling region | reference example |
| 4-3 | 900 | 500 | 100 | 2 | 0.42 | 0.24 | 535 | $68 \times 10^6$ | non-boiling region and nucleate boiling region | reference example |
| 4-4 | 900 | 500 | 100 | 3 | 0.28 | 0.36 | 362 | $43 \times 10^6$ | non-boiling region and nucleate boiling region | reference example |
| 4-5 | 900 | 500 | 100 | 4 | 0.21 | 0.48 | 270 | $36 \times 10^6$ | non-boiling region and nucleate boiling region | reference example |

TABLE 5

<Water film cooling of present invention>

| Experiment level | Evaluation temperature (° C.) | Water flow density W (L/min · $m^2$) | Evaluation length (mm) | Flow channel gap interval (mm) | Flow speed (m/s) | Time for passage (sec) | Heat transfer coefficient α (W/$m^2$ · K) | Q/W (J/$m^3$) | Water film cooling superiority condition (over spraying) | Boiling region of coolant | |
|---|---|---|---|---|---|---|---|---|---|---|---|
| 5-1 | 900 | 500 | 100 | 5 | 0.17 | 0.6 | 876 | $84 \times 10^6$ | A | transition boiling region | invention example |
| 5-2 | 900 | 500 | 100 | 8 | 0.1 | 0.96 | 471 | $45 \times 10^6$ | B | film boiling region | comparative example |
| 5-3 | 900 | 500 | 100 | 10 | 0.08 | 1.2 | 406 | $39 \times 10^6$ | B | film boiling region | comparative example |
| 5-4 | 900 | 500 | 100 | 15 | 0.06 | 1.8 | 278 | $27 \times 10^6$ | B | film boiling region | comparative example |

Subsequently, under the condition of experiment level 3-1 of the present invention, only the arrangement of water supply ports of the coolant guide plate was changed to round holes with a diameter of approximately 5 mm in a staggered arrangement described in Patent Literature 2, and experiment was performed similarly. As a result, cracking occurred on the cooled steel slab surface. It is presumed that in the case where the water supply ports had a staggered arrangement, supplied water did not completely evaporate before reaching a side end of the coolant guide plate in the casting direction, and the film boiling region and the transition boiling region were mixed on the cooling surface, so that temperature unevenness occurred.

INDUSTRIAL APPLICABILITY

The present invention can be applied to a method and a device for performing secondary cooling in performing continuous casting of a casting product in a continuous casting machine.

REFERENCE SIGNS LIST

1 continuous casting machine
2 tundish
3 mold
4 immersion nozzle
5 casting product passage
6, 7 roll group
10, 11 support roll
15 spray nozzle
16 steel slab
17 spray jet of cooling water
21 model device
22 steel slab
23 coolant guide plate
24 water supply nozzle
25 gap
31 cooling device
32 coolant guide plate
33 water supply pipe
34 exhaust pipe
35 gap
36 water supply port
H casting product

The invention claimed is:

1. A secondary cooling method for a casting product casted in a continuous casting machine, the continuous casting machine including, in a secondary cooling zone below a mold, a plurality of pairs of support rolls that support the casting product from both sides of the casting product in a thickness direction, a cooling device being disposed between support rolls adjacent to each other along a casting direction of the continuous casting machine, the cooling device including a coolant pipe that supplies a coolant, and a coolant guide plate with a flat plate shape for spreading the coolant on the casting product, the coolant guide plate being disposed parallel to and spaced in a perpendicular direction from a surface of the casting product, the secondary cooling method comprising:

a step of supplying the coolant from a coolant supply port provided in the coolant guide plate to a gap between the casting product surface and the coolant guide plate, and cooling the casting product using the coolant mainly in a transition boiling region, wherein using the coolant mainly in the transition boiling region comprises using the coolant under conditions such that 80% or more of a flow channel is in a transition boiling state, wherein an interval between the casting product surface and the coolant guide plate is 5 mm or more, and time for the coolant to reach an upstream-side end or a downstream-side end of the coolant guide plate in the casting direction from the coolant supply port is 0.6 seconds or less.

2. The secondary cooling method for a casting product in continuous casting according to claim 1, wherein the coolant supply port is a plurality of holes aligned in one row in a width direction of the casting product or a slit whose longitudinal direction is the width direction of the casting product.

3. The secondary cooling method for a casting product in continuous casting according to claim 1, wherein the coolant is supplied from the coolant supply port in a liquid phase, and, in a flow channel between the casting product surface and the coolant guide plate, entirely enters a gas phase before reaching an upstream-side end or a downstream-side end of the coolant guide plate in the casting direction.

4. The secondary cooling method for a casting product in continuous casting according to claim 1, wherein vapor of the coolant is discharged from at least one of an upstream-side end and a downstream-side end, in the casting direction, of the gap between the casting product surface and the coolant guide plate.

5. The secondary cooling method for a casting product in continuous casting according to claim 1, wherein quantity of heat removal by cooling for the coolant to entirely enter a gas phase before reaching an upstream-side end or a downstream-side end of the coolant guide plate in the casting direction satisfies Formula (A) below:

$$Q/W \geq 59 \times 10^6 \ [\mathrm{J/m^3}] \quad \text{(A)},$$

where Q denotes quantity of heat removal by cooling, and W denotes water flow density.

6. A secondary cooling device for a casting product in continuous casting, the secondary cooling device being disposed between support rolls adjacent to each other along a casting direction, among a plurality of pairs of support rolls that support the casting product from both sides of the casting product in a thickness direction, in a secondary cooling zone below a mold of a continuous casting machine, the secondary cooling device comprising:

a coolant pipe that supplies a coolant; and a coolant guide plate with a flat plate shape for spreading the coolant on the casting product, the coolant guide plate being disposed parallel to and spaced in a perpendicular direction from a surface of the casting product, wherein an interval between the casting product surface and the coolant guide plate is 5 mm or more, and is set in a manner that time for the coolant to reach an upstream-side end or a downstream-side end of the coolant guide plate in the casting direction from a coolant supply port provided in the coolant guide plate is 0.6 seconds or less, and the coolant is supplied from the coolant supply port to a gap between the casting product surface and the coolant guide plate, and the casting product is cooled using the coolant mainly in a transition boiling region, wherein using the coolant mainly in the transition boiling region comprises using the coolant under conditions such that 80% or more of a flow channel is in a transition boiling state.

7. The secondary cooling device for a casting product in continuous casting according to claim 6, further comprising an interval control mechanism that controls the interval between the casting product surface and the coolant guide plate.

8. The secondary cooling device for a casting product in continuous casting according to claim 6, wherein the coolant supply port s a plurality of holes aligned in one row in a width direction of the casting product or a slit whose longitudinal direction is the width direction of the casting product.

9. The secondary cooling device for a casting product in continuous casting according to claim 6, further comprising an exhaust part that discharges the coolant that has entered a gas phase from at least one of an upstream-side end and a downstream-side end, in the casting direction, of the gap between the casting product surface and the coolant guide plate.

* * * * *